US009764332B2

(12) United States Patent
Bush et al.

(10) Patent No.: US 9,764,332 B2
(45) Date of Patent: Sep. 19, 2017

(54) EDGE AIR NOZZLES FOR BELT-TYPE SEPARATOR DEVICES

(71) Applicant: SEPARATION TECHNOLOGIES LLC, Needham, MA (US)

(72) Inventors: Ted W. Bush, Carlisle, MA (US); Kyle P. Flynn, Ashland, MA (US); Harry Vincent Leaf, Marshfield, MA (US); Bulent Sert, Marblehead, MA (US)

(73) Assignee: SEPARATION TECHNOLOGIES LLC, Needham, MA (US)

( * ) Notice: Subject to any disclaimer, the term of this patent is extended or adjusted under 35 U.S.C. 154(b) by 165 days.

(21) Appl. No.: 14/622,450

(22) Filed: Feb. 13, 2015

(65) Prior Publication Data

US 2016/0236206 A1 Aug. 18, 2016

(51) Int. Cl.
*B03C 3/34* (2006.01)
*B03C 7/08* (2006.01)

(52) U.S. Cl.
CPC . *B03C 3/34* (2013.01); *B03C 7/08* (2013.01)

(58) Field of Classification Search
CPC combination set(s) only.
See application file for complete search history.

(56) References Cited

U.S. PATENT DOCUMENTS 1,100,896 A 9/1914 Comstock
1,110,896 A 9/1914 Comstock
1,222,305 A 4/1917 Kraus
1,355,477 A 10/1920 Howell
1,931,322 A 10/1933 Kepler
2,689,648 A 9/1954 Maestas
2,758,666 A 8/1956 Prentiss
2,776,725 A 1/1957 Wood
2,847,124 A 8/1958 Brastad
2,889,042 A 6/1959 Le Baron
3,022,889 A 2/1962 Le Baron et al.
3,096,277 A * 7/1963 Maestas ..... B03C 7/08 209/131
3,140,714 A 7/1964 Murphy, Jr. et al.
3,247,960 A 4/1966 Brastad
(Continued)

FOREIGN PATENT DOCUMENTS

CA 2219133 A1 10/1996
CA 2462033 A1 * 4/2003 ..... B03C 7/08
(Continued)

OTHER PUBLICATIONS

A.R. Savkoor & T.J. Rutyer, "Experimental investigation of the effect of electrical potential on adhesive friction of elastomers", Advances in Polymer Friction & Wear, ed., L-H Lee, (Polymer Science& Technology Symposium Series, vol. 5B, PlenumPress, NY, 1974.

(Continued)

*Primary Examiner* — Amber R Orlando
*Assistant Examiner* — Sonji Turner
(74) *Attorney, Agent, or Firm* — Lando & Anastasi, LLP

(57) ABSTRACT

An improved belt separator system and an improved method to separate particle mixtures based on triboelectric separation of particles is disclosed. One or more gas nozzles, for example, a plurality of gas nozzles are provided as part of the system or installed into a system, such as an existing system, to improve dispersal of particles during operation.

79 Claims, 5 Drawing Sheets

(56) References Cited

U.S. PATENT DOCUMENTS

| | | | | | |
|---|---|---|---|---|---|
| 3,384,692 | A | | 5/1968 | Galt et al. | |
| 3,449,837 | A | | 6/1969 | Giddings | |
| 3,449,938 | A | | 6/1969 | Giddings | |
| 3,493,109 | A | | 2/1970 | Carta et al. | |
| 3,635,340 | A | | 1/1972 | Dunn | |
| 3,664,939 | A | | 5/1972 | Luner et al. | |
| 3,720,312 | A | | 3/1973 | Shook et al. | |
| 3,941,685 | A | | 3/1976 | Singewald et al. | |
| 3,988,410 | A | | 10/1976 | Larsen et al. | |
| 4,122,002 | A | | 10/1978 | Hauskins, Jr. | |
| 4,122,022 | A | | 10/1978 | MacKenzie et al. | |
| 4,137,156 | A | | 1/1979 | Morey et al. | |
| 4,172,028 | A | | 10/1979 | Dunn | |
| 4,211,594 | A | | 7/1980 | Freitag et al. | |
| 4,274,947 | A | | 6/1981 | Beeckmans et al. | |
| 4,297,207 | A | | 10/1981 | Singewald et al. | |
| 4,298,518 | A | | 11/1981 | Ohmura et al. | |
| 4,302,245 | A | | 11/1981 | Winters | |
| 4,321,189 | A | | 3/1982 | Ohshita et al. | |
| 4,358,358 | A | | 11/1982 | Rhodes | |
| 4,430,146 | A | | 2/1984 | Johnson | |
| 4,440,638 | A | | 4/1984 | Judy et al. | |
| 4,451,357 | A | * | 5/1984 | LaVigne | B03C 7/08 209/131 |
| 4,476,004 | A | | 10/1984 | Pohl | |
| 4,482,351 | A | | 11/1984 | Kitazawa et al. | |
| 4,517,078 | A | | 5/1985 | Inculet et al. | |
| 4,533,447 | A | | 8/1985 | Meldon | |
| 4,650,567 | A | * | 3/1987 | McGarry | B03D 1/1462 209/166 |
| 4,701,487 | A | | 10/1987 | Hakim | |
| 4,767,506 | A | | 8/1988 | Fricke | |
| 4,839,032 | A | * | 6/1989 | Whitlock | B03C 7/006 209/11 |
| 4,874,507 | A | * | 10/1989 | Whitlock | B01D 15/02 204/157.3 |
| 5,006,226 | A | | 4/1991 | Burt, Jr. | |
| 5,135,974 | A | | 8/1992 | Moore | |
| 5,188,873 | A | | 2/1993 | Delannoy | |
| 5,251,762 | A | | 10/1993 | Taylor et al. | |
| 5,299,692 | A | * | 4/1994 | Nelson | B03B 9/04 209/11 |
| 5,342,250 | A | | 8/1994 | Sanders | |
| 5,356,682 | A | | 10/1994 | Stewart et al. | |
| 5,358,119 | A | | 10/1994 | Stahl et al. | |
| 5,375,721 | A | * | 12/1994 | LaVigne | B03C 7/08 209/131 |
| 5,447,588 | A | | 9/1995 | Merz et al. | |
| 5,449,390 | A | | 9/1995 | Duncan et al. | |
| 5,484,061 | A | | 1/1996 | Dunn | |
| 5,513,755 | A | * | 5/1996 | Heavilon | B03B 9/04 209/11 |
| 5,562,755 | A | | 10/1996 | Fricke et al. | |
| 5,562,796 | A | | 10/1996 | Ertel | |
| 5,698,358 | A | | 12/1997 | Yu | |
| 5,819,946 | A | * | 10/1998 | Whitlock | C08K 5/34928 209/127.1 |
| 5,829,598 | A | * | 11/1998 | Whitlock | B03C 7/02 209/128 |
| 5,837,115 | A | | 11/1998 | Austin et al. | |
| 5,904,253 | A | * | 5/1999 | Cerullo | B03C 7/08 209/128 |
| 6,066,194 | A | | 5/2000 | Hugghins et al. | |
| 6,074,458 | A | | 6/2000 | Bittner et al. | |
| 6,320,148 | B1 | * | 11/2001 | Yoon | B03C 7/006 209/127.3 |
| 6,375,875 | B1 | | 4/2002 | Paulauskas et al. | |
| 6,942,752 | B2 | | 9/2005 | Whitlock et al. | |
| 7,467,709 | B2 | | 12/2008 | Whitlock et al. | |
| 8,552,326 | B2 | * | 10/2013 | MacKay | B03C 3/30 209/11 |
| 2011/0289923 | A1 | | 12/2011 | Bittner et al. | |

FOREIGN PATENT DOCUMENTS

| | | | | | |
|---|---|---|---|---|---|
| CA | 2219133 | C | * | 1/2007 | B03C 7/02 |
| CN | 1243457 | A | | 2/2000 | |
| DE | 0705007 | C | | 4/1941 | |
| DE | 3527599 | A1 | | 2/1987 | |
| DE | 10351180 | B3 | | 1/2005 | |
| EP | 0080729 | A1 | | 6/1983 | |
| EP | 0109828 | A1 | | 5/1984 | |
| EP | 0499138 | A2 | | 8/1992 | |
| EP | 0613724 | A2 | * | 9/1994 | B01D 15/02 |
| FR | 940389 | A | | 12/1948 | |
| GB | 1039898 | A | | 8/1966 | |
| GB | 2001357 | A | | 1/1979 | |
| GB | 2013303 | A | | 8/1979 | |
| GB | 2139316 | A | | 11/1984 | |
| JP | 10263963 | | * | 10/1998 | |
| JP | 2001-503283 | A | | 3/2001 | |
| JP | 2002-177820 | A | | 6/2002 | |
| JP | 2003-126832 | A | | 5/2003 | |
| JP | 2007-046805 | A | | 2/2007 | |
| JP | 2007046805 | A | * | 2/2007 | |
| JP | 4889268 | B2 | | 3/2012 | |
| JP | 4889269 | B2 | | 3/2012 | |
| RU | 1787555 | C | | 1/1993 | |
| RU | 49588 | U1 | | 11/2005 | |
| RU | 49842 | U1 | | 12/2005 | |
| SU | 0495088 | A1 | | 12/1975 | |
| SU | 0498042 | A1 | | 1/1976 | |
| SU | 602225 | A1 | | 4/1978 | |
| SU | 1007735 | A1 | | 3/1983 | |
| SU | 1196033 | A1 | | 12/1985 | |
| SU | 1475720 | A1 | | 4/1989 | |
| WO | 8707532 | A1 | | 12/1987 | |
| WO | 8909092 | A1 | | 10/1989 | |
| WO | WO 8909092 | A1 | * | 10/1989 | B01D 15/02 |
| WO | WO 9627635 | A1 | * | 9/1996 | C08K 5/34928 |
| WO | WO 9633809 | A1 | * | 10/1996 | B03C 7/02 |
| WO | 97/20633 | A1 | | 6/1997 | |
| WO | WO 9720633 | A1 | * | 6/1997 | B01D 19/0084 |
| WO | 2007014402 | A1 | | 2/2007 | |

OTHER PUBLICATIONS

Adamson, R.J. and Kaler, K.V.I.S., "An Automated Stream Centered Dielectrophoretic System," Conference Record of the 1986 IEEE Industry Applications Society Annual Meeting Part II, Sep. 28-Oct. 3, 1986, IEEE Catalog No. 86CH2272-3, pp. 1350-1354.

Akzo Nobel "Polymer Additives", brochure, Bulletin 94-25, 1994.

Atochem Inc., Polymers Division, Facts about Rilsan p. 10 (1986).

Ausimont USA, Inc., "When Plastic Parts are Part Polymist, They're Better Parts" brochure (1985-1995).

B.J. Briscoe, C.M. Pooley and D. Tabor, in "Friction & Wear of some polymers in unlubicated sliding", Advances in Polymer Friction & Wear, ed., L-H Lee, (Polymer Science & Technology Symposium Series, vol. 5B, Plenum Press, NY, 1974.

Chemie Linz production brochure on "Melamine Cyanurate additive for Plastics".

Dow Corning Corp., "A Guide to Dow Corning Products", p. 31 (1977).

du Pont "Guide to processing Kevlar Aramid Fiber and pulp for friction products" brochure, p. 1 E-65333, Jun. 1984.

du Pont Kevlar Aramid Fiber Technical Guide brochure,, p. III-1 H-46267, Dec. 1992.

du Pont Teflon Fluroadditive brochure 44662, undated (but issued between 1988 and 1994).

du Pont Zytel-Kevlar SFC Short Fibert Composite Brochure H-42527, Feb. 1994.

Gachter and Muller, Plastics Additive Handbook, 3rd Edition, Haser, p. 632 (1990).

Hoechst Plastics Hostalen GUR brochure, p. 16 HKR 112 Feb. 1981.

International Search Report and Written Opinion from PCTUS2016017394 mailed Jun. 27, 2016.

(56) References Cited

OTHER PUBLICATIONS

J.D. Bittner et al: "Triboelectric Belt Separator for Beneficiation of Fine Minerals", Procedia Engineering, vol. 83, Jan. 2014 (Jan. 2014), pp. 122-129.
John E. Theberge, Jane Crosby and Marygail Hutchins "Greater Property Uniormity from Aramid-Reinforced Thermoplastics, Reprint from Machine Design, Feb. 7, 1985—Reinforceds Thermoplastics".
LNP Corporation, Malvern, PA, "Lubricomp Internally Lubricated Reinforced Thermoplastics and Fluoropolymer Composites," Bulletin 254-998, undated (but probably from 1985-1990).
Lonza Plastic Additive Selection Guide, brochure BP, Sep. 1994.
Lonza spec sheet on Acrawax C (ethylene bisstearamide), revised Mar. 1993.
Notification of Transmittal of the International search Report and the Written Opinion of the International Searching Authority, or the Declaration dated Jan. 19, 2012 for PCT/US2011/050148.
Plastics Compounding magazine, 17/(4), Jul./Aug. 1994, p. 22.
R.J. Gruber & P.C. Julien, "Dry Toner Technology", A.S. Diamond, ed., Handbook of Imaging Materials, Marcel Dekker, 1991.
RTP Corp, Winona, MN brochure "Wear Resistant Thermoplastics" (1991).
SME Mineral Processing Handbook—Norman L. Weiss, Pub. by Society of Mining Engineers of the American Institute of Mining, Metallurgical, andPetroleum Engineers, Inc. 1985, pp. 6-34.
Synthetic Product Company, Technical data sheet on "Petrac Slip-Pure" TD-003, rev Feb. 10, 1994.
Whitlock, D.R., "Electrostatic Separation of Unburned Carbon from Fly Ash," Proceedings Tenth Int. Ash Use Symposium, vol. 2, 1993,pp. 70-1-70-2, XP002063618.

* cited by examiner

EDGE AIR NOZZLES FOR BELT-TYPE SEPARATOR DEVICES

BACKGROUND

Field of Invention

The present invention relates to a system of gas nozzles, for example, pressurized gas injection nozzles, installed in a belt-type separator device to fluidize particles within a belt-type separator system. The present invention may relate to a system comprising pressurized gas injection nozzles installed in a belt-type separator device to fluidize particles in the longitudinal outside edge of the separation zone of a belt-type separator device, for example, a belt separation apparatus, to fluidize a particle mixture to allow for triboelectric charging and subsequent triboelectric separation of the particles that accumulate on one or more edges of the belt separation apparatus.

Discussion of Related Art

Belt separator systems (BSS) are used to separate the constituents of particle mixtures based on the charging of the different constituents by surface contact (i.e., the triboelectric effect). FIG. 1 shows a belt separator system 10 such as is disclosed in commonly-owned U.S. Pat. Nos. 4,839,032 and 4,874,507, which are hereby incorporated by reference in their entirety. One embodiment of belt separator system 10 includes parallel spaced electrodes 12 and 14/16 arranged in a longitudinal direction to define a longitudinal centerline 18, and a belt 20 traveling in the longitudinal direction between the spaced electrodes, parallel to the longitudinal centerline. The belt 20 forms a continuous loop which is driven by a pair of end rollers 22, 24. A particle mixture is loaded onto the belt 20 at a feed area 26 between electrodes 14 and 16. Belt 20 includes counter-current traveling belt segments 28 and 30 moving in opposite directions for transporting the constituents of the particle mixture along the lengths of the electrodes 12 and 14/16. The only moving part of the BSS is the belt 20. The belt is therefore a critical component of the BSS. The belt 20 moves at a high speed, for example, about 40 miles an hour, in an extremely abrasive environment. The two belt segments 28, 30 move in opposite directions, parallel to centerline 18.

SUMMARY OF INVENTION

Aspects and embodiments are directed to a system to deliver a gas, for example a high pressure fluidizing gas such as air to a belt separation apparatus or system, for example, the longitudinal inside edge of the separation zone of a belt separation apparatus or system.

One embodiment of the belt separation system comprises a series of air nozzles installed at periodic locations along inside of the wall of the BSS separation zone wall to deliver compressed gas on a continuous or intermittent basis to fluidize or de-agglomerate the difficult to fluidize powder to make it amenable to electrostatic separation by the BSS.

Another embodiment of the belt separation system comprises a series of air nozzles installed at periodic locations along the inside of the wall of the BSS separation zone to inject relative humidity (RH) controlled air on a continuous or intermittent basis to enhance the triboelectric separation properties of the subject material while simultaneously fluidizing the powder.

Another embodiment of the belt separation system comprises a series of air nozzles installed at periodic locations along the inside of the wall of the BSS separation zone to inject relative humidity (RH) and temperature controlled air on a continuous or intermittent basis to enhance the triboelectric separation properties of the subject material while simultaneously fluidizing the powder.

In some embodiments, a belt separator system is provided. The belt separator system comprises a first electrode and a second electrode arranged on opposite sides of a longitudinal centerline and configured to provide an electric field between the first and second electrodes. The belt separator system further comprises a first roller disposed at a first end of the system, a second roller disposed at a second end of the system, and a continuous belt disposed between the first and second electrodes and supported by the first roller and the second roller. The belt separator system further comprises a separation zone defined by and between the continuous belt, and a plurality of gas nozzles positioned at periodic locations along a wall of the system to deliver gas to the separation zone.

According to aspects of this embodiment, the system further comprises a source of gas fluidly connected to an inlet of at least one gas nozzle of the plurality of gas nozzles. According to aspects of the embodiment, the source of gas is a pressurized gas. According to aspects of the embodiment, the source of gas is pressurized air. According to aspects of the invention, the gas is at selected conditions such that after the gas has expanded through the nozzle it is provided at at least one of a pre-determined temperature and a pre-determined pressure of the expanded gas. According to aspects of the embodiment, the source of gas is at a selected relative humidity condition to provide a pre-determined relative humidity, for example, in the separation zone. According to aspects of the embodiment, the pre-determined relative humidity is in a range of about 0% to about 75%, measured at ambient pressure, for example zero psig in the separation zone. According to aspects of the embodiment, the source of gas is at a selected temperature condition to provide a pre-determined temperature, for example, in the separation zone. According to aspects of the embodiment, the pre-determined temperature is in a range of about 60 degrees Fahrenheit (° F.) to about 250° F. in the separation zone. According to certain aspects of the embodiment, the source of gas is at selected conditions in order to provide pre-determined relative humidity and a pre-determined temperature in the separation zone. According to aspects of the embodiment, the pre-determined relative humidity is in a range of about 0% to about 75% and the pre-determined temperature is in a range of about 60° F. to about 250° F. According to aspects of the embodiment, the pre-determined relative humidity is provided through at least one of dehumidification, steam addition, and liquid water addition to the source of gas. According to aspects of the embodiment, the gas is conditioned to have a relative humidity about equal to a relative humidity of a process air, for example, the process air in the separation zone. According to aspects of the embodiment, the gas is dry air. According to aspects of the embodiment, the source of pressurized gas is at ambient conditions. According to aspects of the embodiment, the plurality of gas nozzles are configured to deliver pressurized gas on at least one of a continuous basis and an intermittent basis. According to aspects of the embodiment, the system comprises a timing device to provide gas at the intermittent basis at a pre-determined interval. According to aspects of the embodiment, the pre-determined interval is between about zero seconds and about 30 seconds. According to aspects of the embodiment, the pre-determined interval is about 10 seconds. According to aspects of the embodiment, the plurality of gas nozzles are configured to deliver pressurized gas at a pressure of about 10 pounds per square inch gauge (psig) to about 100 psig. According to aspects of the embodiment, the plurality of gas nozzles are configured to deliver pressurized gas at a pressure of about 15 psig to about 25 psig. According to aspects of the embodiment, the plurality of gas nozzles are configured to deliver pressurized gas at a pressure of about 25 psig. According to aspects of the embodiment, the plurality of gas nozzles are configured to deliver pressurized gas at a pressure of about 60 psig. According to aspects of the embodiment, the plurality of air nozzles are positioned to maximize fluidization of a powder to be separated in the system, without exposing the air nozzles to an abrasive high shear zone created by the continuous belt. According to aspects of the embodiment, the plurality of gas nozzles are positioned at an angle in a range of about 90 degrees to a direction of travel of the continuous belt to 45 degrees from normal relative to the direction of travel of the belt. According to aspects of the embodiment, the system further comprises an abrasion resistant, electrically insulating, ceramic material positioned on the wall of the system, internally to the separation zone. According to aspects of the embodiment, the plurality of air nozzles are installed through the wall of the system and an abrasion resistant liner positioned adjacent the wall and the separation zone. According to aspects of the embodiment, the source of gas is fluidly connected to at least one of a dehumidification system, a source of steam, and a source of liquid water. According to aspects of the embodiment, the continuous belt comprises periodic notches formed within a longitudinal edge at periodic locations in the longitudinal edge of the belt, the periodic notches configured for conveying components of a difficult-to-fluidize material in a direction along a longitudinal direction of the belt separator system. According to aspects of the embodiment, the notches formed in the longitudinal edge of the belt have a beveled edge. According to aspects of the embodiment, the bevel edge of each notch has a radius in a range of 4-5 mm. According to aspects of the embodiment, the notches formed in the longitudinal edge of the belt have a triangular-shape. According to aspects of the embodiment, a leading edge of the notch has an angle in a range from about 12° to about 45° with respect to the longitudinal edge. According to aspects of the embodiment, the belt includes counter-current belt segments traveling in opposite directions along the longitudinal direction. According to aspects of the embodiment, the notches in the longitudinal edges have dimensions selected to maximize throughput of the belt separator system for a difficult-to-fluidize material. According to aspects of the embodiment, the notch in the longitudinal edge has dimensions selected to maximize an operating lifetime of the belt for a difficult-to-fluidize material. According to aspects of the embodiment, wherein the belt has a width about 1 to 5 millimeters short of a width of the inside of the belt separator system and the edges in the longitudinal edges of the belt are configured to sweep components of the difficult-to-fluidize material away from the inside edge of the separation system.

In certain other embodiments, a method of fluidizing a particle mixture within a belt separator system is provided. The method comprises introducing the particle mixture to a feed port of the belt separator system, in which the system comprises a first electrode and a second electrode arranged on opposite sides of a longitudinal centerline and configured to provide an electric field between the first and second electrodes. The system further comprises a first roller disposed at a first end of the system, a second roller disposed at a second end of the system, a continuous belt disposed between the first and second electrodes and supported by the first roller and the second roller, and a separation zone defined by and between the continuous belt. The method of fluidizing a particle mixture within the belt separator system comprises delivering a gas through a gas nozzle positioned along a wall of the system to deliver gas to the separation zone.

According to aspects of this embodiment, delivering the gas through the gas nozzle comprises delivering a pressurized gas. According to aspects of this embodiment, delivering the gas through the gas nozzle comprises delivering a gas intermittently, for a pre-determined interval. According to aspects of this embodiment, the pre-determined interval is between about zero seconds to about 30 seconds. According to aspects of this embodiment, the pre-determined interval is about 10 seconds. According to aspects of this embodiment, delivering a gas through a gas nozzle comprises delivering the gas through a gas nozzle at a pressure of about 10 pounds per square inch gauge (psig) to about 100 psig. According to aspects of this embodiment, the plurality of gas nozzles are configured to deliver pressurized gas at a pressure of about 15 psig to about 25 psig. According to aspects of this embodiment, the pressure is about 25 psig. According to aspects of this embodiment, the pressure is about 60 psig. According to aspects of this embodiment, the method further comprises operating the continuous belt at a velocity between about 10 feet per second (3.0 meters per second) and about 100 feet per second (30.5 meters per second). According to aspects of this embodiment, delivering a gas through the gas nozzle provides for an at least 10% decrease in a belt motor torque. According to aspects of this embodiment, delivering a gas through the gas nozzle provides for an at least 100% increase in belt life of the continuous belt. According to aspects of this embodiment, the method further comprises delivering a gas to provide the gas at a pre-determined relative humidity equal to that of a process air, which provides for an at least about 75% decrease in an electrode coating by the particle mixture. According to aspects of this embodiment, the method further comprises conditioning the gas to have a relative humidity about equal to a relative humidity of a process air. According to aspects of this embodiment, the method further comprises conditioning the gas to have a relative humidity of dry air in the separation zone, prior to delivering the gas. According to aspects of this embodiment, the method further comprises at least one of humidifying or dehumidifying the gas prior to delivering the gas. According to aspects of this embodiment, the method further comprises operating at an increased voltage as compared to a system without air nozzles, thereby improving separation of electrically insulating powders. According to aspects of this embodiment, the method further comprises operating at a decreased electrode gap as compared to a system without air nozzles, thereby improving separation of the particle mixture.

In certain other embodiments, a method for facilitating an operating life of a belt separation system is provided. The method comprises installing a plurality of gas nozzles positioned along a wall of the belt separation system, in which the system comprises a first electrode and a second electrode arranged on opposite sides of a longitudinal centerline and configured to provide an electric field between the first and second electrodes, a first roller disposed at a first end of the system, a second roller disposed at a second end of the system, and a continuous belt disposed between the first and second electrodes and supported by the first roller and the second roller. According to aspects of this embodiment, the method further comprises connecting the plurality of gas nozzles to a source of gas. According to aspects of this embodiment, the method further comprises connecting the plurality of gas nozzles to a source of pressurized gas. According to aspects of this embodiment, the method further comprises connecting the plurality of gas nozzles to a source of pressurized gas conditioned to at least one of a pre-determined relative humidity and a pre-determined temperature. According to aspects of this embodiment, the method further comprises connecting the source of pressurized gas to at least one of dehumidifier, a source of steam, and a source of liquid water. According to aspects of this embodiment, the method further comprises conditioning the gas to have a relative humidity about equal to a relative humidity of a process air. According to aspects of this embodiment, the method further comprises conditioning the gas to have a relative humidity of dry air in the separation zone, prior to delivering the gas. According to aspects of this embodiment, the method further comprises operating at an increased voltage as compared to a system without air nozzles, thereby improving separation of electrically insulating powders. According to aspects of this embodiment, the method further comprises operating at a decreased electrode gap as compared to a system without air nozzles, thereby improving separation of the particle mixture. According to aspects of this embodiment, the method further comprises introducing the particle mixture to a feed port of the belt separator system. According to aspects of this embodiment, the method further comprises operating the continuous belt at a velocity between about 10 feet per second (3.0 meters per second) and about 100 feet per second (30.5 meters per second). According to aspects of this embodiment, the method further comprises delivering the gas through a gas nozzle positioned along a wall of the system to deliver gas to the separation zone. According to aspects of this embodiment, the method further comprises, delivering the gas through the gas nozzle comprises delivering a pressurized gas. According to aspects of this embodiment, delivering the gas through the gas nozzle comprises delivering a gas intermittently, for a pre-determined interval. According to aspects of this embodiment, the pre-determined interval is about 0 to about 30 seconds. According to aspects of this embodiment, the pre-determined interval is about 10 seconds. According to aspects of this embodiment, delivering the gas through a gas nozzle comprises delivering the gas through a gas nozzle at a pressure of about 10 pounds per square inch gauge (psig) to about 100 psig. According to aspects of this embodiment, the plurality of gas nozzles are configured to deliver pressurized gas at a pressure of about 15 psig to about 25 psig. According to aspects of this embodiment, the pressure is about 25 psig. According to aspects of this embodiment, the pressure is about 60 psig. According to aspects of this embodiment, delivering a gas through the gas nozzle provides for an at least 10% decrease in a belt motor torque. According to aspects of this embodiment, delivering a gas through the gas nozzle provides for an at least 100% increase in belt life of the continuous belt. According to aspects of this embodiment, the method further comprises delivering a gas to provide the gas at a pre-determined relative humidity equal to that of process air, which provides for an at least about 75% decrease in an electrode coating by the particle mixture. According to aspects of this embodiment, the plurality of gas nozzles are positioned at an angle in a range of about 90 degrees to a direction of travel of the continuous belt to 45 degrees from normal relative to the direction of travel of the belt.

BRIEF DESCRIPTION OF THE DRAWINGS

Various aspects of at least one embodiment are discussed below with reference to the accompanying figures, which are not intended to be drawn to scale. The figures are included to provide illustration and a further understanding of the various aspects and embodiments, and are incorporated in and constitute a part of this specification, but are not intended as a definition of the limits of the invention. Where technical features in the figures, detailed description or any claim are followed by reference signs, the reference signs have been included for the sole purpose of increasing the intelligibility of the figures and description. In the figures, each identical or nearly identical component that is illustrated in various figures is represented by a like numeral. For purposes of clarity, not every component may be labeled in every figure. In the figures:

DETAILED DESCRIPTION

Figure 1:
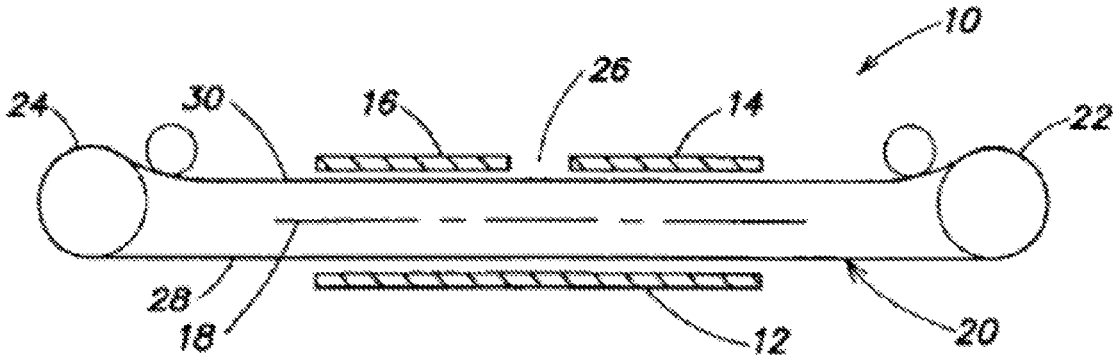
FIG. 1 (PRIOR ART)
FIG. 1 illustrates a diagram of one example of belt separator system (BSS)

Systems and methods are provided as improvements to belt separator systems and operation of such systems. The systems and methods provided herein may improve or increase the operating life of belt separator systems through lengthening the life of the continuous belt of the system. This may be accomplished by decreasing the accumulation of particles on and around the belt, thereby providing more efficient processing of materials and use of the equipment in the system. This may allow for optimized operation of the system, and reduces costs associated with operation and time lost due to necessary equipment replacement.

It is to be appreciated that embodiments of the methods and apparatuses discussed herein are not limited in application to the details of construction and the arrangement of components set forth in the following description or illustrated in the accompanying drawings. The methods, systems, and apparatuses are capable of implementation in other embodiments and of being practiced or of being carried out in various ways. Examples of specific implementations are provided herein for illustrative purposes only and are not intended to be limiting. Also, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to embodiments or elements or acts of the systems and methods herein referred to in the singular may also embrace embodiments including a plurality of these elements, and any references in plural to any embodiment or element or act herein may also embrace embodiments including only a single element. Any reference to front and back, left and right, top and bottom, upper and lower, and vertical and horizontal are intended for convenience of description, not to limit the present systems and methods or their components to any one positional or spatial orientation.

The present disclosure is directed to a system comprising one or more gas nozzles that may be installed in a belt-type separator system, for example a belt separator system, for example, in a triboelectric counter-current belt-type separator system.

Aspects and embodiments are directed to an improved belt that may be used in a belt separation apparatus to separate a particle mixture based on triboelectric charging of the particles, and more specifically to an improved belt having notches in each impermeable longitudinal edge. The improved belt is particularly suitable for triboelectric separation of particles that tend to accumulate on the edges of the belt separation apparatus and/or tend to compound, or blend, with the belt material. The improved belt also results in an improved separation process, improved belt lifetime, reduced failure of the belt and less down time for the separation apparatus.

Figure 2:
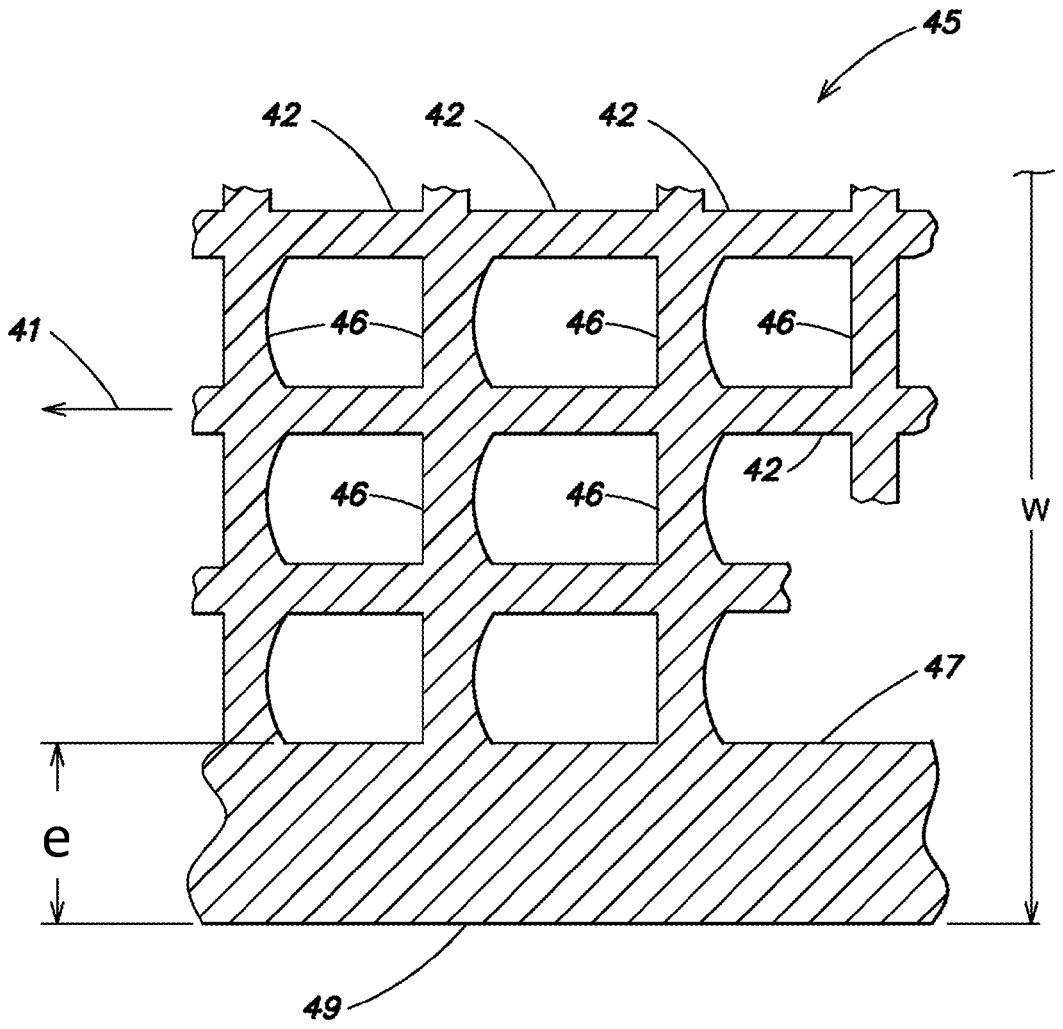
FIG. 2 (prior art)
FIG. 2 illustrates a plan view of an extruded belt, in accordance with certain embodiments of the present disclosure.

FIG. 2 shows the embodiment of the BSS with a continuous counter current belt moving between two longitudinal, parallel planar electrodes (electrodes not shown). Inside edges (55 of FIG. 3) of the separation chamber are not directly swept by the belt 45. It is desirable to minimize the area of the unswept zone (see FIG. 3, located between belt 54 and abrasion resistant liner 55) of the edges of the separation chamber, since it represents electrode area that is not effective for particle separation. However, it is also typical to leave a gap between the edge 47 of the belt 45 and the inside edge of the separation chamber to prevent the belt from rubbing and wearing against the inside edge of the separation chamber (see 55 of FIG. 3), which could lead to early belt failure. Therefore the width W (see FIG. 2) of the belt 45 is approximately 20 mm narrower than the width of the separation chamber, in order to leave about 10 mm clearance between the inside wall (55 of FIG. 3) of the separation chamber and the edges 47 of the belt 45. This unswept area provides a location for difficult-to-fluidize feed to accumulate, which over time can be compacted by the motion of the separator belt, providing an abrasive surface for the belt to rub against, thereby reducing its operating life due to failure by edge abrasion and other related failure modes.

Belts may be made of various materials. For example, woven belts or extruded belts may be used.

Referring to FIG. 2, one current design of an ultra high molecular weight polyethylene (UHMWPE) belt 45 has straight and smooth machine direction edge strands 47 that are thicker than the machine direction strands 42 or the cross direction strands 46 in the interior of the belt. These wider (20-30 mm) edge strands 47 serve to carry more of the tension load, provide dimensional stability and reduce the incidence of belt failure by edge 49 abrasion.

These UHMWPE sheet belts 45 have proven to have much longer life than extruded belts. In certain applications, such as the separation of unburned carbon from coal combustion fly ash, these UMHWPE belts have had been tested and shown to have a maximum life of up to 1950 hours before failure.

The fluidization characteristics of powders is one parameter in determining how the particles of the powder are conveyed and separated in a BSS. Section 3.5 in Pneumatic Conveying of Solids by Klinzig G. E. et al., second edition 1997, describes materials loosely as "fluidizable" or "difficult-to-fluidize". This property is qualitatively assessed by the behavior of the material in a fluidized bed. The fluidization property of powders is generally accepted to be influenced by the powder particle size, specific gravity, particle shape, surface moisture, and by other less well understood properties. Coal combustion fly ash is an example of an easily fluidizable powder. Many other industrial mineral powders are more difficult to fluidize than fly ash.

Difficult-to-fluidize powders can greatly reduce the operating life of the BSS belt by providing a compacted surface for the belt edge 49 to rub against at high velocity, for example 40 miles per hour. For such difficult-to-fluidize or more cohesive powders, such as many industrial minerals, the shear force generated by the moving belt 45 is not typically sufficient to overcome the interparticle forces in the powder, which results in a build-up of compacted, thermally insulating, abrasive powder on the inside edge of the separation chamber in the zone between the inside wall of the separation chamber (for example, see 55 on FIG. 3 and FIG. 4) and the edges 47 of the belt 45 that the belt 45 does not sweep. Over hours of operation this reduces the width of the belt edge 47, e, until the belts edge 47 is removed completely and the open cells of the belt 46 are exposed.

Furthermore, some difficult to fluidize powders can also chemically compound with the material of the separator belt, leading to the formation of solidified mineral and belt deposits which often times permanently damage the BSS belt, requiring replacement. Such non-fluidized abrasive powder that can also become trapped, or sandwiched, between the machine direction edge strands 42 of the top section of the belt 30 and the bottom section of the belt 28 (See FIG. 1) which are moving in opposite directions at relative velocities from 10 to 100 ft/sec. The abrasion between the moving belt segments, enhanced by the non-fluidized abrasive powder, leads to small fragments of belt material being removed from the belt and frictional heating of the edge strands 47 over their width and along their length.

At these elevated temperatures, the small fragments of plastic belt material and the powder tend to fuse together to form composites of powder and plastic, which can grow to 10-200 mm in length and 5-25 mm wide. With the edge of the belt 47 now running against these plastic-powder compound deposits, they cause further frictional heating and eventually destroy the edge of the belt, sometimes even fusing the belt strands together. The composition of a typical thermoplastic-powder composite that was retrieved from a belt failure caused by the buildup of this composite residue has been measured as approximately 50% thermoplastic and 50% industrial mineral powder. This phenomenon of plastic powder composite buildup and accumulation on the unswept edges 47 of the BSS separation chamber has led to extremely short belt life in the range of tens of hours for the BSS when processing some industrial minerals (particularly non-fluidized minerals). Frequent belt replacement leads to increased maintenance costs and costs associated with lost production.

The abrasion of the separator plastic belt against the stagnant, difficult-to-fluidize powder, and the subsequent thermoplastic-powder deposits also results in increased belt motor torque. Belt motor torque is the sum of the forces acting against the belt as it travels through the electrode gap. Belt motor torque increases with the amount of powder present in the separator, the distance between the opposing electrodes, the coarseness and degree of fluidization of the powder and the speed of the belt. Difficult-to-fluidize powders increase the belt motor torque required at a given processing condition by accumulating on the unswept edges of the separation chamber, providing a surface for the belt to wear. Elevated belt motor torques can result in increased belt wear and more frequent process shutdowns due to belt stoppage or belt breaks. To prevent excessively high belt motor torques it is often necessary to make a processing change, such as increasing the distance between the opposing electrodes. Increasing the electrode gap reduces the belt motor torques, but often reduces the effectiveness of the separation, resulting in higher mineral losses and lower purity product.

By contrast, easily fluidizable powders, such as coal combustion fly ash, are effectively swept from the inside edges of the separation chamber by the motion of the belt 45. This occurs because the motion of the belt 45 creates a shear force which exceeds the inter-particle forces between particles of the coal combustion fly ash and between particles of the combustion fly ash and the edge walls of the separation chamber. One solution, documented in patent application number U.S. Ser. No. 14/261,056, and incorporated herein by reference in its entirety, is a modification to the continuous open mesh belt to allow for openings along the longitudinal edge of the belt to convey stagnant, difficult to fluidize powder away from the edge of the separation chamber. Although an improvement over the prior art belt, the openings in the longitudinal edge of the belt are limited in their conveying capacity. Abrasive wear on the edge of the belt continues to occur with belts containing notches, however, at a slower rate than belts without notches.

It is well established in literature that the triboelectric charging process is sensitive to small amounts of surface moisture. This surface moisture, measured and reported as relative humidity (RH), can impact the separation performance of a BSS by influencing the tribocharging properties of the material of interest. Methods to control relative humidity of material, specifically coal fly ash, entering a BSS have been established and disclosed in commonly-owned U.S. Pat. No. 6,074,458, which is hereby incorporated by reference in its entirety. It is therefore desirable to control the RH of any air entering the separation zone of a BSS to match that of the optimum RH for the material of interest. Any deviation from this optimum RH will result in undesirable effects in the triboelectrostatic separation of the material of interest. Such RH control of air entering the belt separator apparatus nozzles can be achieved by many methods including dehumidification, steam or liquid water addition.

One consequence of failing to adequately control relative humidity in a triboelectrostatic BSS is the accumulation of finely ground, electrically insulating, mineral powders on the surface of the electrodes, which are unable to be removed by the action of the separator belt. These accumulations of insulating layers on the surface of the electrodes have the effect of reducing the efficiency of the electrostatic separation.

Belt separator systems may be provided that include gas nozzles to disperse and fluidize difficult to fluidize materials or particles that my reside in unswept areas of the system or on the belt. The gas nozzles may be referred to as air nozzles, pressured gas nozzles, or pressurized air nozzles. In certain aspects, the gas may be any inert gas that maintains the gas phase upon addition to a belt-type separator system. In certain embodiments, the gas may be air or pressurized air.

The system may comprise one or more gas nozzles that may be installed to penetrate the longitudinal edge of the separation zone of a belt separator apparatus or system and inject, for example, compressed gas, that may aerate difficult-to-fluidize powders that would otherwise remain stagnant on the unswept edges of the separation zone. The system of one or more gas nozzles has been shown to have a beneficial effect on the longevity of the separator belt, reducing early belt failures due to belt edge abrasion. Furthermore, embodiments of the disclosure have been demonstrated to reduce the frequency of solid deposit formation due to belt material and powder compounding. Embodiments of the disclosure have also been shown to allow for a reduction in the operating belt motor torque of the belt separator apparatus, allowing for separation to occur at narrower electrode gaps and higher voltage gradients, leading to an improvement in separation performance.

Such a system of compressed gas, for example air, injectors comprises one or more nozzles located in the system to provide gas, for example, pressurized gas, to the system to disperse particles within the system. For example, in certain embodiments, the nozzles may be located in the longitudinal edge of the belt separator apparatus wall, directed in such a way as to supply compressed gas at angles to provide such dispersal of particles. The angles may range from perpendicular to the direction of travel of the separator belt to 45 degrees from normal relative to the direction of travel of the belt. Gas nozzles, for example air nozzles, may be operated in such a way as to supply gas, such as air, continuously during operation, or intermittently by a timing device.

The delivery of gas intermittently may occur through regular (repetitious, consistent) intervals, or may be provided on an irregular basis. For example, in some embodiments, gas may be delivered for an interval between about zero or 1 to about 30 seconds. In some examples, gas may be delivered for an interval of about 10 seconds. In other examples, gas may be delivered first at an interval of about 10 seconds, then at an interval of about 30 seconds, and then at another interval of about 20 seconds.

The nozzles may comprise one or more air outlets in order to maximize the efficiency of the one or more nozzles in dispersing and/or fluidizing the material. The nozzles may be spaced at desired positions throughout out the system to provide an optimal dispersal and/or fluidization of material. For example, the nozzles may be spaced at between about 1 inch to about 12 inch intervals. Each interval between positioned nozzle may be the same or different, depending on the desired pressurized air release to the system in order to achieve optimal or desired dispersal and/or fluidization of material. Nozzles may be operated at pressures ranging from about 10 to about 100 psig, although a set point of about 25 psig may be selected in some applications.

Figure 3:
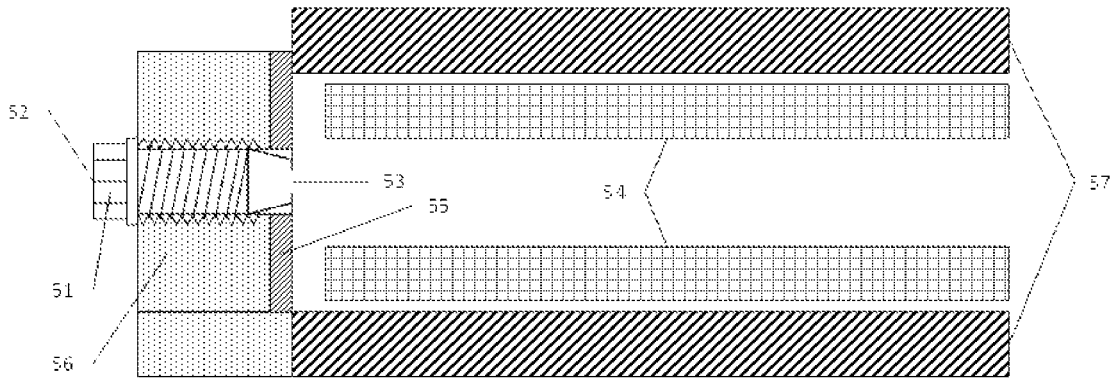
FIG. 3 illustrates an elevation view of a gas nozzle system, in accordance with certain embodiments of the present disclosure.
Figure 4:
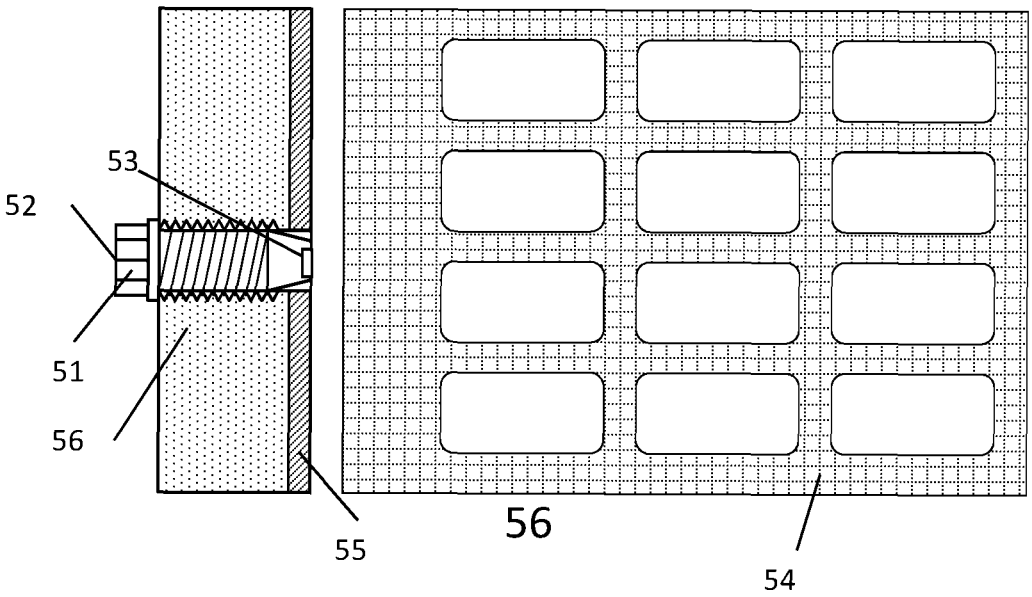
FIG. 4 illustrates a plan view of a gas nozzle system, in accordance with certain embodiments of the present disclosure.

One embodiment of such a system of gas nozzles is shown in FIG. 3 and FIG. 4. The gas nozzle 51 is installed through the wall of the belt separator system 56 and the abrasion resistant liner 55. Compressed gas at a pressure between about 10 and about 100 psig is supplied to the nozzle inlet 52. The compressed gas may be supplied at a controlled relative humidity, a controlled temperature, controlled relative humidity and temperature, or compressed air from ambient inlet conditions, without adjusting relative humidity or temperature. Ambient conditions may be conditions in which humidity is not controlled by a dehumidifier/humidifier, steam generator, liquid water addition, and/or temperature is not controlled by any type of heat exchange device. Instead, these properties of the gas are based upon the local weather conditions. For example, a range of ambient conditions may be between about −10° F. to about 100° F.; between about 0% to about 100% relative humidity, at atmospheric pressure. The compressed gas is introduced into the separation chamber from the nozzle exit 53. Abrasive difficult to fluidize mineral deposits are thus removed from the path of travel of the separator open mesh belt 54 and separator electrodes 57 by the compressed gas stream.

As referred to herein, relative humidity (RH) is a humidity that changes with pressure. Therefore, the RH measured when the air is pressurized in the nozzle, and the RH measured immediately after the nozzle, at ambient pressure, will be different.

As referred to herein, process air is air that is conditioned for relative humidity and temperature to a selected relative humidity and temperature by one or more of a dehumidifier/humidifier, steam generator, liquid water addition, fan, blower, air compressor, or heat exchange device.

The separation zone of the belt separator apparatus is a highly abrasive environment, as particles are moving at high velocity, for example, 40 miles per hour, relative to the separator electrodes. For this reason, it may be desirable to construct all components exposed to the particle stream of abrasion resistant materials to improve or maximize their service life. Included in this is the inside, longitudinal edge of the belt separator apparatus separation zone, which is constructed of an abrasion resistant, electrically insulating, ceramic material through which the air nozzles penetrate. Therefore, it is important to position or configure the gas nozzles in such a way as to maximize the fluidizing effect to the powder without exposing the nozzle to the abrasive high shear zone created by the belt.

A key benefit of gas nozzles for difficult to fluidize powders is a significant improvement in the longevity of separator belts due to reduced edge wear. Gas nozzles have also been shown to be effective in reducing the frequency of solid belt and mineral deposits forming along the edge of the belt separator system when processing difficult to fluidize materials. The benefit of using gas nozzles has been measured directly as a reduction in the amount of torque required to drive the belt separator apparatus belt, referred to as "belt torque" or "belt motor torque." The torque requirements to drive the belt may be determined by one or more factors including the distance between the opposing electrodes, the speed of the belt, the thickness and material of construction of the belt, the particle size distribution and fluidization properties of the powder being processed, and the rate of powder processed. The gas nozzles reduce the belt motor torque requirements by reducing losses to friction at the edge of the belt, where the belt is moving at high velocity against otherwise stagnant, difficult-to-fluidize powder. Additional reduction in belt motor torque occurs through fluidization of the feed, for example, a mineral feed, entering the belt separator system through the active feed port. It may be desirable to operate using lower belt motor torque as it allows for less belt wear and allows for more aggressive processing conditions. Furthermore, by requiring less torque to drive the separator belt, less static tension pressure is required to transfer motion from the drive rollers to the separator belt without slipping. This results in increased belt longevity due to longer times before belt failure due to belt material stretching.

It is well established in literature that the triboelectric charging process is sensitive to small amounts of surface moisture. This surface moisture, measured and reported as relative humidity (RH), can impact the separation performance of a BSS by influencing the tribocharging properties of the material of interest. It, therefore, may be desirable in some embodiments, to control the RH of any gas or air entering the separation zone of a BSS to match that of the optimum RH for the material of interest. Any deviation from this optimum RH may result in undesirable effects in the triboelectrostatic separation of the material of interest. Such RH control of air entering the belt separator apparatus nozzles can be achieved by many methods including dehumidification, steam or liquid water addition.

One consequence of failing to adequately control relative humidity in a triboelectrostatic BSS may be the accumulation of finely ground, electrically insulating, mineral powders on the surface of the electrodes, which are unable to be removed by the action of the separator belt. These accumulations of insulating layers on the surface of the electrodes may have the effect of reducing the electric field and thus reducing the efficiency of the electrostatic separation. It therefore may be desirable to optimize the relative humidity of the air supplied to the air nozzles to prevent these accumulations of electrically insulating powder. Furthermore this may allow the separation process itself to be optimized, as removing the electrically insulating powder deposits at the locations of the air nozzles, through optimum relative humidity control, the electrodes may be brought closer together during processing, resulting in a higher electric field strength, better cleaning action of the continuous loop belt and increased particle to particle contact.

In certain embodiments, a source of gas, such as a source of air, may be provided to be delivered through one or more gas nozzles to provide gas to the system, for example, the separation chamber or the separation zone. The gas provided to the system may be the gas provided to the system after delivery through the nozzle, i.e., an expanded gas. The gas from the source of gas may be at selected conditions such that after the gas has expanded through the nozzle it is provided at at least one of a pre-determined temperature and a pre-determined pressure of the expanded gas. The gas provided to the system may have a pre-determined relative humidity and/or pre-determined temperature. The gas provided to the system having the pre-determined relative humidity and/or pre-determined temperature may be provided to the system, for example, the separation zone or chamber, through conditioning of the source of gas. The pre-determined relative humidity of the gas provided to the system may be between about 0% relative humidity to about 75% relative humidity. The pre-determined temperature of the gas provided to the system may be between about 60° F. and about 250° F. The air that may be conditioned, may be conditions from a feed air source. The conditioning of the air to provide for pre-determined relative humidity and/or temperature may be achieved through a dehumidifier/humidifier, steam generator, liquid water addition, fan, blower, air compressor, or heat exchange device.

Figure 5A:
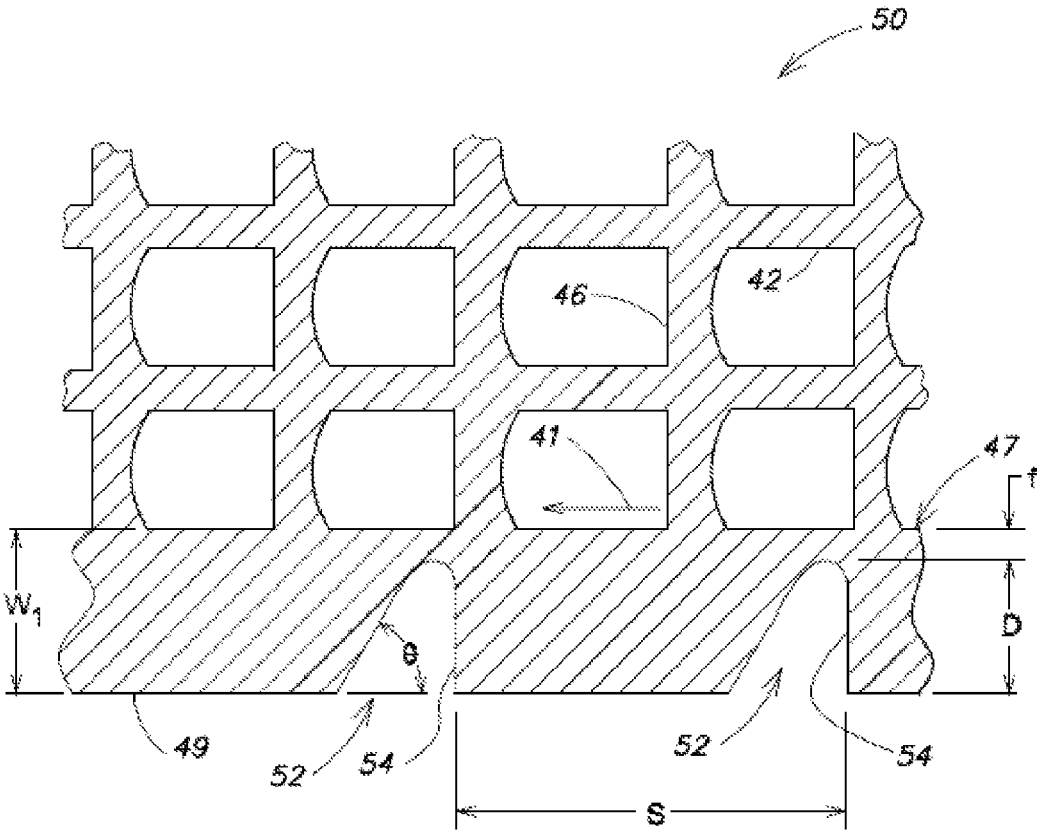
FIG. 5A illustrates a plan view of an improved belt for a BSS.

Referring to FIG. 5A, there is illustrated a plan view of an improved belt for a BSS, particularly for processing and separating some industrial materials (particularly non-fluidized materials). To improve belt life when processing "difficult to fluidize" particles using a BSS, the improved belt design 50 has been provided with continuous (having a width $W_1$ of about 20 to about 30 mm wide) edge strands 47 on each side of the belt (only one side of the belt is illustrated), which have been modified by creating open notches 52 of a prescribed shape and location. These notches 52 can be obtained through various forming means such as molding, punching, machining, water jet cutting, laser cutting, and the like.

The edge notches 52 of FIG. 5A provide a mechanism, pathway and conveying mechanism for powder sandwiched between edge strands 47 of oppositely moving belt segments 28, 30 (see FIG. 1) to convey the particles of powder in either direction of belt motion. It is to be appreciated that the removal of stagnant powder between the edge strands 47 of oppositely moving belt segments 28, 30 (see FIG. 1) significantly reduces abrasion and frictional heating. This belt

Figure 5B:
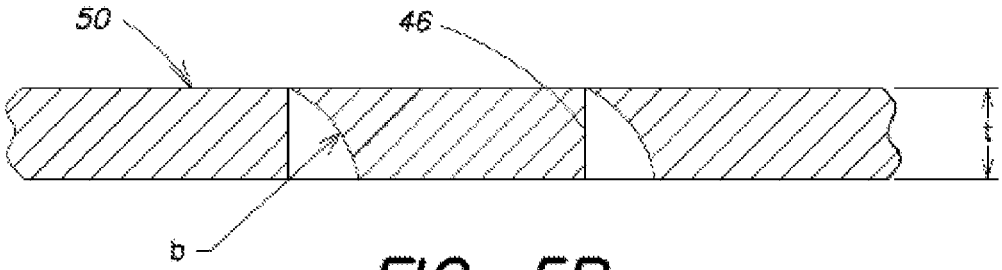
FIG. 5B illustrates a side view of the belt of FIG. 5A.

50 having such edge notches 52 has been tested in existing BSS of FIG. 1, and it has been shown that the use of belts with notched edges 52 has eliminated the formation of the plastic-powder composite build-up material that has historically resulted in short belt file. This belt 50 having such edge notches 52 has been tested in existing BSS of FIG. 1, and it has been shown that the belt life has increased to 100's of hours when processing "difficult to fluidize" industrial mineral powders. This compares to belt life in the 10's of hours for other belts having straight edge strands 47 without any notches, such as shown in FIG. 2. The trailing edge 54 of the notch 52 perpendicular to the edge of the belt 49 and the direction the belt is moving 41 provides a motive force to move powder in the direction of the belt motion. The volume of the notch 52, which is determined by depth of notch D, length of notch L, angle Ø, and thickness t of the belt (See FIG. 5B), provides the carrying capacity of each notch 52. The spacing between notches (S) determines the carrying capacity of the belt per unit belt length of the belt. FIG. 5B illustrates a side view of the belt 50 and the notch 52, and in particular illustrates that the edges of the notch, such as the trailing edge 46, can be provided we a bevel having a bevel radius of b.

The improved belt design described herein may be used in conjunction with the gas nozzles disclosed herein in order to improve the performance and life of the belt separator system.

EXAMPLES

Example 1

In one example, a system of air nozzles was installed on a test section of a belt separator apparatus and cycled on and off on a periodic basis. A total of 26 air nozzles were installed on a single side of a belt separator system, each nozzle was spaced 4 inches apart. Nozzle size varied between 0.020 to 0.040 inches in diameter. Several air nozzles had multiple (for example two or three) air injector locations. Other air nozzles had one air injector location. Air pressure at the pipe header prior to the nozzles was maintained at about 60 psig. Compressed air was introduced at low relative humidity, for example below 5% relative humidity when measured at ambient pressure (0 psig), and was not adjusted to match the relative humidity of the process air used to control the RH of the separator feed material. Nozzles were operated in a repeating cycle; nozzles were off for about 30 seconds, and then nozzles were on for about 10 seconds. Belt motor torque for the time period when the air nozzles was on averaged 30% of full motor load. Belt motor torque for time when the air nozzles were cycled off was 33%. A regular and periodic oscillation was observed during the time when the air nozzles were cycled on and off. For time periods when the air nozzles were on, the belt motor torque was, on average, 10% lower in relative terms. Upon cycling the air nozzles off, the belt motor torque increased.

Example 2

In another example, a system of air nozzles was installed on a test section of a belt separator apparatus and cycled on and off for an extended period to quantify the effect. A total of 26 air nozzles were installed on a single side of a belt separator system, with each nozzle spaced 4 inches apart. Nozzle opening size varied between 0.020 and 0.040 inches in diameter. Several air nozzles had multiple air injector locations. The air nozzles were supplied with dried compressed air at a relative humidity that was less than that of the process air. Belt motor torque with the air nozzles on was 27%. Belt motor torque with the air nozzles turned off increased to 36%, a relative increase of 33% in motor torque required to drive the separator belt.

Example 3

In another example, a system of air nozzles was installed on the entire length of a belt separator apparatus. Intervals of 4 inches were used between each air injection point. Air nozzle size was 0.040 inches in diameter. Air nozzles were operated continuously while the separator belt was operating. Compressed air was supplied at about 15 to about 25 psig. The operation of the air nozzles was found to have a significant effect on the operating life of the separator belt. Maximum belt life without any air nozzles was 124 hours. Maximum belt life with air nozzles supplying compressed, dried air at low relative humidity was 272 hours. Maximum belt life with air nozzles supplying compressed air, RH conditioned to match the relative humidity of the process air, was 628 hours.

Example 4

In another example, a system of air nozzles was installed and operated on the entire length of a belt separator apparatus. Intervals of 4 inches were used between each air injection point. Air nozzle size was 0.040 inches in diameter. Air nozzles were operated continuously while the separator belt was operating. Compressed air was supplied at about 15-25 psig. The relative humidity of the air supplied to the air nozzles was found to have a significant effect on the depth of electrode coating by finely ground, electrically insulating mineral powder. With dry, for example below 5% relative humidity when measured at ambient pressure (0 psig), compressed air supplied to the air nozzles, electrode coating was 1.2-2.1 $kg/m^2$ of electrode area for areas where electrode coating was evident, generally near the separator wall, adjacent to the air jets. Electrode coating by fine particles was less than 0.3 $kg/m^2$ of electrode area for areas in which electrode coating was observed when the air nozzles were operated with RH controlled air at a relative humidity equal to that of the process air.

Example 5

In another example, a synthetic (95%/5%) mixture of ground, agricultural grade calcium carbonate (Poultrycal 120) and silica sand (Flint) with a mean particle size of 60 microns was separated by a belt separator apparatus without air nozzles. A series of separation experiments was performed at constant operating conditions, except for the distance between the two opposing electrodes, the electrode gap, which was varied from 0.48 to 0.38 inches, in evenly spaced intervals of 0.02 inches. As the electrode gap was decreased, the rejection of acid insoluble (AI) silica sand was increased as the content of silica sand was decreased in the low AI, calcium carbonate enriched product. Simultaneously, the belt motor torques increased as the electrode gap decreased. This contrast between separation performance and motor torque is detailed in Table 1 below.

| Electrode Gap Inch | Acid Insoluble Content of Low AI Product Percent | Mass Recovery of Calcium Carbonate Percent | Belt Motor Torques Percent |
|---|---|---|---|
| 0.48 | 3.7% | 96.5% | 25% |
| 0.46 | 2.8% | 95.9% | 28% |
| 0.44 | 3.8% | 96.2% | 31% |
| 0.42 | 2.5% | 95.4% | 36% |
| 0.40 | 2.1% | 94.7% | 46% |
| 0.38 | 1.8% | 94.9% | 62% |

It is apparent from the processing results presented in the above table that considerable value can be obtained from improving the separation performance of the BSS by reducing the electrode gap. As the installation and operation of air nozzles on a belt separator apparatus allows for tighter electrode gap operation at reduced torques, air nozzles in effect allow for improvement in separation results as more optimal separator operating conditions can be achieved.

Example 6

In another example, a synthetic (95%/5%) mixture of ground, agricultural grade calcium carbonate (Poultrycal 120) and silica sand (Flint) with a mean particle size of 60 microns was separated by a belt separator apparatus without air nozzles. A series of separation experiments was performed at constant operating conditions, except for the strength of the electric field between the two opposing electrodes, which was varied from about 20 kV/inch to about 50 kV/inch, in increments of 10 kV/inch. As electric field strength increased, the silica sand remaining in the carbonate enriched product decreased.

| Electric Field Strength kV/Inch | Acid Insoluble Content of Low AI Product Percent | Mass Recovery of Calcium Carbonate Percent | Belt Motor Torques Percent |
|---|---|---|---|
| 20 | 1.8% | 95.2% | 52% |
| 30 | 1.4% | 92.9% | 55% |
| 40 | 1.2% | 92.9% | 61% |
| 50 | 0.9% | 92.5% | 60% |

It is apparent from the processing results presented above that for some electrically insulating, finely ground mineral powders, increased electric field strength in a belt separator apparatus can result in improved processing, increasing the value of the separated products. One limitation to increasing electric field strength in a BSS processing electrically insulating, difficult-to-fluidize mineral powders is the collection and buildup of fine mineral particles which adhere to the surface of the electrodes and reduce the efficiency of the separation. This accumulation of fine, electrically insulating mineral fines occurs most readily at the outside edges of the belt separator apparatus when the relative humidity of the air supplied to the air nozzles is outside the optimum range for the process. Increasing the electric field strength of the belt separator apparatus has been shown to increase the deleterious effects of this fine, electrically insulating mineral layer. By installing air nozzles along the outside edge of the separation zone, and supplying the nozzles with RH controlled air at the relative humidity of the process air, this electrode buildup of fine powder is greatly reduced, allowing for operation with increased voltage and subsequently improved processing of electrically insulating powders.

Having thus described certain embodiments of a belt separator system comprising at least one gas nozzle, methods of operating the same and fluidizing a particle mixture, and methods of facilitating an operating life of a belt separation system, various alterations, modifications and improvements will be apparent to those of ordinary skill in the art. Such alterations, variations and improvements are intended to be within the spirit and scope of the application. Accordingly, the foregoing description is by way of example and is not intended to be limiting. The application is limited only as defined in the following claims and the equivalents thereto.

What is claimed is:

1. A belt separator system comprising:

a first electrode and a second electrode arranged on opposite sides of a longitudinal centerline and configured to provide an electric field between the first and second electrodes;

a first roller disposed at a first end of the system;

a second roller disposed at a second end of the system;

a continuous belt disposed between the first and second electrodes and supported by the first roller and the second roller;

a separation zone defined by and between the continuous belt; and a plurality of gas nozzles positioned at periodic locations along a wall adjacent to the separation zone to deliver gas to the separation zone.

2. The belt separator system of claim 1, further comprising a source of gas fluidly connected to an inlet of at least one gas nozzle of the plurality of gas nozzles.

3. The belt separator system of claim 2, wherein the source of gas is a pressurized gas.

4. The belt separator system of claim 2, wherein the source of gas is pressurized air.

5. The belt separator system of claim 3, wherein the source of gas is at a selected relative humidity condition to provide a pre-determined relative humidity in the separation zone.

6. The belt separator system of claim 5, wherein the pre-determined relative humidity is in a range of about 0% to about 75% in the separation zone.

7. The belt separator system of claim 3, wherein the source of gas is at a selected temperature condition to provide a pre-determined temperature in the separation zone.

8. The belt separator system of claim 7, wherein the pre-determined temperature is in a range of about 60° F. to about 250° F. in the separation zone.

9. The belt separator system of claim 5, wherein the source of gas is at a selected temperature condition to provide a pre-determined temperature in the separation zone.

10. The belt separator system of claim 9, wherein the pre-determined relative humidity is in a range of about 0% to about 75% and the pre-determined temperature is in a range of about 60° F. to about 250° F. in the separation zone.

11. The belt separator system of claim 5, wherein the pre-determined relative humidity is provided through at least one of dehumidification, steam addition, and liquid water addition to the source of gas.

12. The belt separator system of claim 5, wherein the gas is conditioned to have a relative humidity about equal to a relative humidity of a process air in the separation zone.

13. The belt separator system of claim 5, wherein the gas is dry air.

14. The belt separator system of claim 3, wherein the source of pressurized gas is at ambient conditions.

15. The belt separator system of claim 1, wherein the plurality of gas nozzles are coupled to a gas compressor with a controller configured to compress the gas and to deliver pressurized gas on at least one of a continuous basis and an intermittent basis.

16. The belt separator system of claim 15, further comprising a timing device to provide gas at the intermittent basis at a pre-determined interval.

17. The belt separator system of claim 16, wherein the pre-determined interval is between about zero seconds to about 30 seconds.

18. The belt separator system of claim 17, wherein the pre-determined interval is about 10 seconds.

19. The belt separator system of claim 3, wherein the plurality of gas nozzles are coupled to a gas compressor with a controller configured to compress the gas and to deliver pressurized gas at a pressure of about 10 pounds per square inch gauge (psig) to about 100 psig.

20. The belt separator system of claim 18, wherein the plurality of gas nozzles are coupled to a gas compressor with a controller configured to compress the gas and to deliver pressurized gas at a pressure of about 15 psig to about 25 psig.

21. The belt separator system of claim 20, wherein the plurality of gas nozzles are coupled to a gas compressor with a controller configured to compress the gas and to deliver pressurized gas at a pressure of about 25 psig.

22. The belt separator system of claim 19, wherein the plurality of gas nozzles are coupled to a gas compressor with a controller configured to compress the gas and to deliver pressurized gas at a pressure of about 60 psig.

23. The belt separator system of claim 1, wherein the plurality of gas nozzles are positioned along the wall without exposing the gas nozzles to an abrasive high shear zone created by the continuous belt.

24. The belt separator system of claim 23, wherein the plurality of gas nozzles are positioned along the wall at an angle in a range of about 90 degrees to a direction of travel of the continuous belt to 45 degrees from normal relative to the direction of travel of the belt.

25. The belt separator system of claim 1, further comprising an abrasion resistant, electrically insulating, ceramic material positioned on the wall of the system, internally to the separation zone.

26. The belt separator system of claim 1, wherein the plurality of air nozzles are installed through the wall of the system and an abrasion resistant liner positioned adjacent the wall and the separation zone.

27. The belt separator system of claim 5, wherein the source of gas is fluidly connected to at least one of a dehumidification system, a source of steam, and a source of liquid water.

28. The belt separator system of claim 1, wherein the continuous belt comprises periodic notches formed within a longitudinal edge at periodic locations in the longitudinal edge of the belt, the periodic notches configured for conveying components of a material in a direction along a longitudinal direction of the belt separator system.

29. The system of claim 28, wherein the notches formed in the longitudinal edge of the belt have a beveled edge.

30. The system of claim 29, wherein the bevel edge of each notch has a radius in a range of 4-5 mm.

31. The system of claim 28, wherein the notches formed in the longitudinal edge of the belt have a triangular-shape.

32. The system of claim 28, wherein a leading edge of the notch has an angle in a range from about 12° to about 45° with respect to the longitudinal edge.

33. The system of claim 28, wherein a trailing edge of the notch is perpendicular with respect to the longitudinal edge.

34. The system of claim 28, wherein the belt includes counter-current belt segments traveling in opposite directions along the longitudinal direction.

35. The system of claim 28, wherein the notches in the longitudinal edges assist in increasing-throughput of the belt separator system for the material.

36. The system of claim 28, wherein the notches in the longitudinal edge assist in increasing an operating lifetime of the belt.

37. The system of claim 28, wherein the belt has a width about 1 to 5 millimeters short of a width of the inside of the belt separator system and the edges in the longitudinal edges of the belt sweep components of the material away from the inside edge of the separation system.

38. A method of fluidizing a particle mixture within a belt separator system comprising:

introducing the particle mixture to a feed port of the belt separator system, the system comprising:

a first electrode and a second electrode arranged on opposite sides of a longitudinal centerline and configured to provide an electric field between the first and second electrodes;

a first roller disposed at a first end of the system;

a second roller disposed at a second end of the system;

a continuous belt disposed between the first and second electrodes and supported by the first roller and the second roller; and a separation zone defined by and between the continuous belt; and delivering a gas through a gas nozzle positioned along a wall adjacent to the separation zone to deliver gas to the separation zone.

39. The method of claim 38, wherein delivering the gas through the gas nozzle comprises delivering a pressurized gas.

40. The method of claim 38, wherein delivering the gas through the gas nozzle comprises delivering a gas intermittently, for a pre-determined interval.

41. The method of claim 40, further comprising delivering the gas through the gas nozzle intermittently at a pre-determined interval of between about zero seconds to about 30 seconds.

42. The method of claim 41, wherein the pre-determined interval is about 10 seconds.

43. The method of claim 38, wherein delivering a gas through a gas nozzle comprises delivering the gas through a gas nozzle at a pressure of about 10 pounds per square inch gauge (psig) to about 100 psig.

44. The method of claim 43, wherein the plurality of gas nozzles are coupled to a gas compressor with a controller configured to compress the gas and to deliver pressurized gas at a pressure of about 15 psig to about 25 psig.

45. The method of claim 44, wherein the pressure is about 25 psig.

46. The method of claim 43, wherein the pressure is about 60 psig.

47. The method of claim 38, further comprising operating the continuous belt at a velocity between about 10 feet per second (3.0 meters per second) and about 100 feet per second (30.5 meters per second).

48. The method of claim 38, wherein delivering a gas through the gas nozzle provides for an at least 10% decrease in a belt motor torque.

49. The method of claim 46, wherein delivering a gas through the gas nozzle provides for an at least 100% increase in belt life of the continuous belt.

50. The method of claim 46, further comprising delivering a gas to provide the gas at a pre-determined relative humidity equal to that of a process air, which provides for an at least about 75% decrease in an electrode coating by the particle mixture.

51. The method of claim 38, further comprising conditioning the gas to have a relative humidity about equal to a relative humidity of a process air.

52. The method of claim 38, further comprising conditioning the gas to have a relative humidity of dry air in the separation zone, prior to delivering the gas.

53. The method of claim 38, further comprising at least one of humidifying or dehumidifying the gas prior to delivering the gas.

54. The method of claim 38, further comprising operating the separator system at a voltage improving separation of electrically insulating powders.

55. The method of claim 38, further comprising operating the separator at an electrode gap improving separation of the particle mixture.

56. A method for facilitating an operating life of a belt separation system comprising:

installing a plurality of gas nozzles positioned along a wall of the belt separation system adjacent a separation zone, the system comprising:

a first electrode and a second electrode arranged on opposite sides of a longitudinal centerline and configured to provide an electric field between the first and second electrodes;

a first roller disposed at a first end of the system;

a second roller disposed at a second end of the system; and a continuous belt disposed between the first and second electrodes and supported by the first roller and the second roller that define the separation zone by and between the continuous belt;

delivering a gas to the separation zone through the plurality of gas nozzles positioned along the wall adjacent to the separation zone.

57. The method of claim 56, further comprising connecting the plurality of gas nozzles to a source of gas.

58. The method of claim 56, further comprising connecting the plurality of gas nozzles to a source of pressurized gas.

59. The method of claim 56, further comprising connecting the plurality of gas nozzles to a source of pressurized gas conditioned to at least one of a pre-determined relative humidity and a pre-determined temperature.

60. The method of claim 59, further comprising connecting the source of pressurized gas to at least one of dehumidifier, a source of steam, and a source of liquid water.

61. The method of claim 59, further comprising conditioning the gas to have a relative humidity about equal to a relative humidity of a process air.

62. The method of claim 59, further comprising conditioning the gas to have a relative humidity of dry air in the separation zone, prior to delivering the gas.

63. The method of claim 56, further comprising operating the separator at a voltage improving separation of electrically insulating powders.

64. The method of claim 56, further comprising operating the separator at an electrode gap improving separation of the particle mixture.

65. The method of claim 56, further comprising introducing the particle mixture to a feed port of the belt separator system.

66. The method of claim 65, further comprising operating the continuous belt at a velocity between about 10 feet per second (3.0 meters per second) and about 100 feet per second (30.5 meters per second).

67. The method of claim 66, further comprising delivering the gas through a gas nozzle positioned along a wall of the system to deliver gas to the separation zone.

68. The method of claim 67, wherein delivering the gas through the gas nozzle comprises delivering a pressurized gas.

69. The method of claim 67, wherein delivering the gas through the gas nozzle comprises delivering a gas intermittently, for a pre-determined interval.

70. The method of claim 69, wherein delivering the gas through the gas nozzle comprises delivering a gas intermittently, for a pre-determined interval of about zero seconds to about 30 seconds.

71. The method of claim 70, wherein the pre-determined interval is about 10 seconds.

72. The method of claim 67, wherein delivering the gas through a gas nozzle comprises delivering the gas through a gas nozzle at a pressure of about 10 pounds per square inch gauge (psig) to about 100 psig.

73. The method of claim 68, wherein the plurality of gas nozzles are coupled to a gas compressor with a controller configured to compress the gas and to deliver pressurized gas at a pressure of about 15 psig to about 25 psig.

74. The method of claim 73, wherein the pressure is about 25 psig.

75. The method of claim 72, wherein the pressure is about 60 psig.

76. The method of claim 67, wherein delivering a gas through the gas nozzle provides for an at least 10% decrease in a belt motor torque.

77. The method of claim 67, wherein delivering a gas through the gas nozzle provides for an at least 100% increase in belt life of the continuous belt.

78. The method of claim 67, further comprising delivering a gas to provide the gas at a pre-determined relative humidity equal to that of a process air, which provides for an at least about 75% decrease in an electrode coating by the particle mixture.

79. The method of claim 56, wherein the plurality of gas nozzles are positioned at an angle in a range of about 90 degrees to a direction of travel of the continuous belt to 45 degrees from normal relative to the direction of travel of the belt.

* * * * *